United States Patent [19]

Musci

[11] 4,400,893

[45] Aug. 30, 1983

[54] SHOE WITH REMOVABLY-MOUNTED HEEL

[75] Inventor: Nicola Musci, Caracas, Venezuela

[73] Assignee: Fratelli Musci, Caracas, Venezuela

[21] Appl. No.: 300,515

[22] Filed: Sep. 9, 1981

[51] Int. Cl.[3] ..... A43B 13/28; A43B 21/36

[52] U.S. Cl. ..... 36/24.5; 36/36 R; 36/42; 12/142 J

[58] Field of Search ..... 36/42, 24.5, 36 R, 36 C, 36/100; 12/142 J

[56] References Cited

U.S. PATENT DOCUMENTS

| | | | |
|---|---|---|---|
| 2,114,993 | 4/1938 | Brandt | 36/24.5 |
| 2,544,878 | 3/1951 | Dratler | 36/36 R |
| 4,320,588 | 3/1982 | Sottolana | 36/24.5 |

FOREIGN PATENT DOCUMENTS

| | | | |
|---|---|---|---|
| 1156338 | 10/1963 | Fed. Rep. of Germany | 36/42 |
| 1093363 | 11/1967 | United Kingdom | 36/24.5 |
| 1108867 | 10/1966 | United Kingdom | |
| 1149434 | 6/1967 | United Kingdom | |
| 1030576 | 10/1963 | United Kingdom | |
| 917582 | 9/1969 | United Kingdom | |

*Primary Examiner*—James Kee Chi

*Attorney, Agent, or Firm*—Cushman, Darby & Cushman

[57] ABSTRACT

A basic design of heel-needing shoe is provided having a sole member made of semi-rigid molded plastic material including a thickened heel stub or jack portion having a downwardly-tapering outer perimetrical sidewall extending about the back and the lateral sides, and a downwardly-opening cylindrically-walled centrally-located socket. The upper surface of the sole member overlying this thickened portion is preferably provided with a small-diameter opening axially communicating with the well. The upper end of the heel is provided with a centrally located axially upwardly projecting cylindrical boss, preferably centrally provided with an upwardly opening threaded bore. The boss is surrounded by a flat upper end surface. An upstanding flange extends about the back and sides of this end surface. The inner surface of this flange tapers to match the heel jack. The heel is disassembly assembled to the basic heel-needing shoe by inserting the heel boss into the jack socket and threading a screw through the sole opening into the boss bore. Two designs of shoe/heel visible interface are shown.

7 Claims, 5 Drawing Figures

12
14
24
36
56
54
36
34
32
30
78
64
74
62
76
72
60
M
70
66
66
58
68
16
10
28
20
82
18
26
22

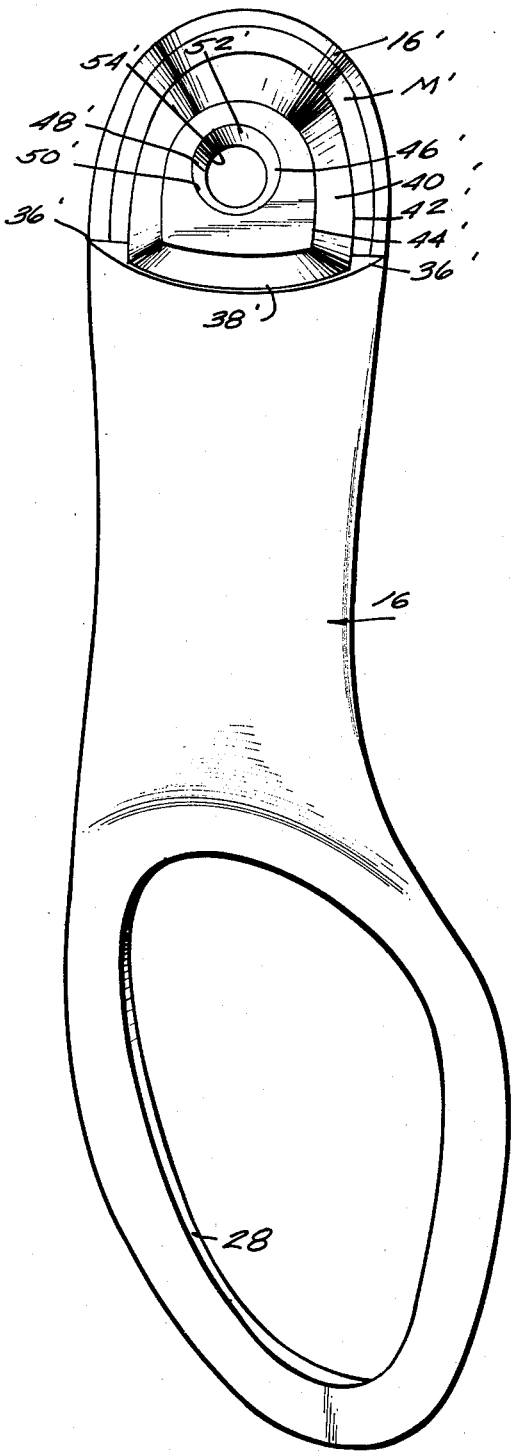
Fig. 5
Fig. 2
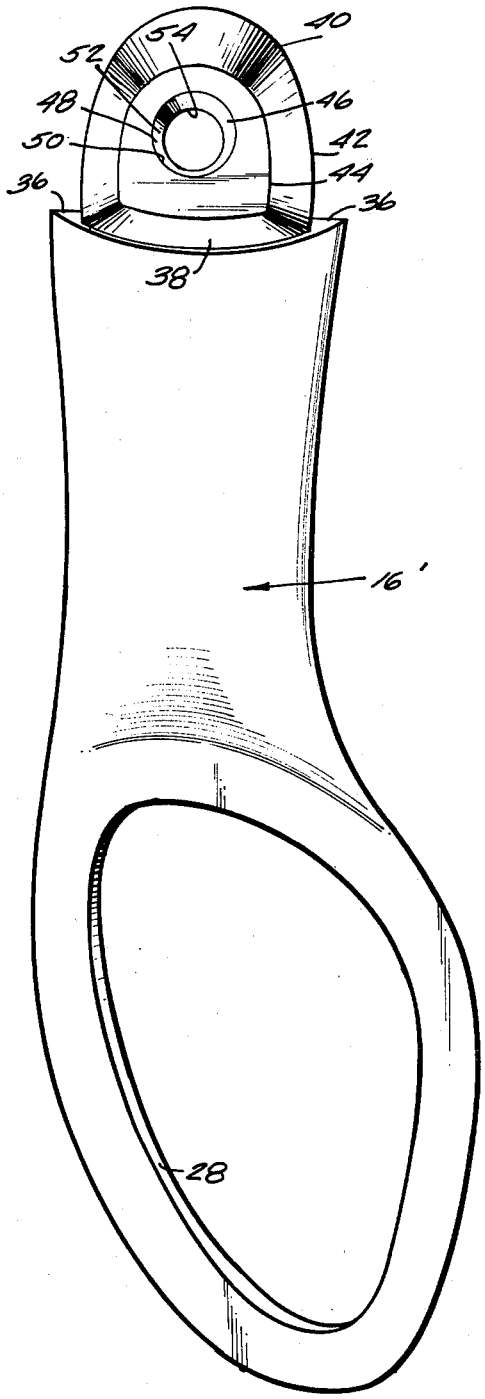

64'
62'
70'
66'
82'
76'
68'
58'
22'
16'
18'
24'
10'
16'
40'
14'
52'
36'
38'
44'
50'
46'
34'
48'
40'
32'
60'
20'
22'

SHOE WITH REMOVABLY-MOUNTED HEEL

BACKGROUND OF THE INVENTION

For the shoe manufacturer, the shoe marketer and the shoe consumer it is considered an advantage to have a basic design of shoe which can be used to have a substantially different appearance with only a modest expenditure.

Accordingly, various ways and means have been proposed for providing this advantage to one or more of these interests. One way that a basic design of shoe can be substantially changed in appearance is to offer it with various styles, types, colors and/or quality-grades of heel. If the various designs of heel for a basic design of shoe are permanently applied during manufacture of the shoe, then the manufacturer may be the only one to derive a substantial benefit, although the marketer and consumer may be enabled by this rationalization of the manufacturing process to afford a better grade of shoe, if some of the economy is passed on down to the marketer and consumer. It appears that a substantial majority of prior inventions in this field relate to systems in which the heels and the heel-needing shoes may be largely separately manufactured, but once assembled to one another at the factory are meant to stay assembled for the life of the shoe. In these cases the shoes are not meant to be easily provided with new or different heels either for fashion or renewal purposes. Thus, the marketers and consumers of shoes have been largely or wholly denied the benefits of being able to substantially alter the appearance of a basic design of shoe by easily selecting a heel to be assembled with a basic design of heel-needing shoe, or to exchange the existing heel with another which looks different, is newer, is higher or lower, is more elegant or more sporty, is slimmer or more blocky, is of one color or another, is made of a more or less expensive covering material, matches one wardrobe, or another, and the like.

SUMMARY OF THE INVENTION

A basic design of heel-needing shoe is provided having a sole member made of semi-rigid molded plastic material including a thickened heel stub or jack portion having a downwardly-tapering outer perimetrical sidewall extending about the back and the lateral sides, and a downwardly-opening cylindrically-walled centrally-located socket. The upper surface of the sole member overlying this thickened portion is preferably provided with a small-diameter opening axially communicating with the well. The upper end of the heel is provided with a centrally located axially upwardly projecting cylindrical boss, preferably centrally provided with an upwardly opening threaded bore. The boss is surrounded by a flat upper end surface. An upstanding flange extends about the back and sides of this end surface. The inner surface of this flange tapers to match the heel jack. The heel is disassembly assembled to the basic heel-needing shoe by inserting the heel boss into the jack socket and threading a screw through the sole opening into the boss bore. Two designs of shoe/heel visible interface are shown.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 2 is a bottom plan view of the sole member of the shoe of FIG. 1.

FIG. 5 is a bottom plan view of the sole member of the shoe of FIG. 3.

DETAILED DESCRIPTION

Figure 1:
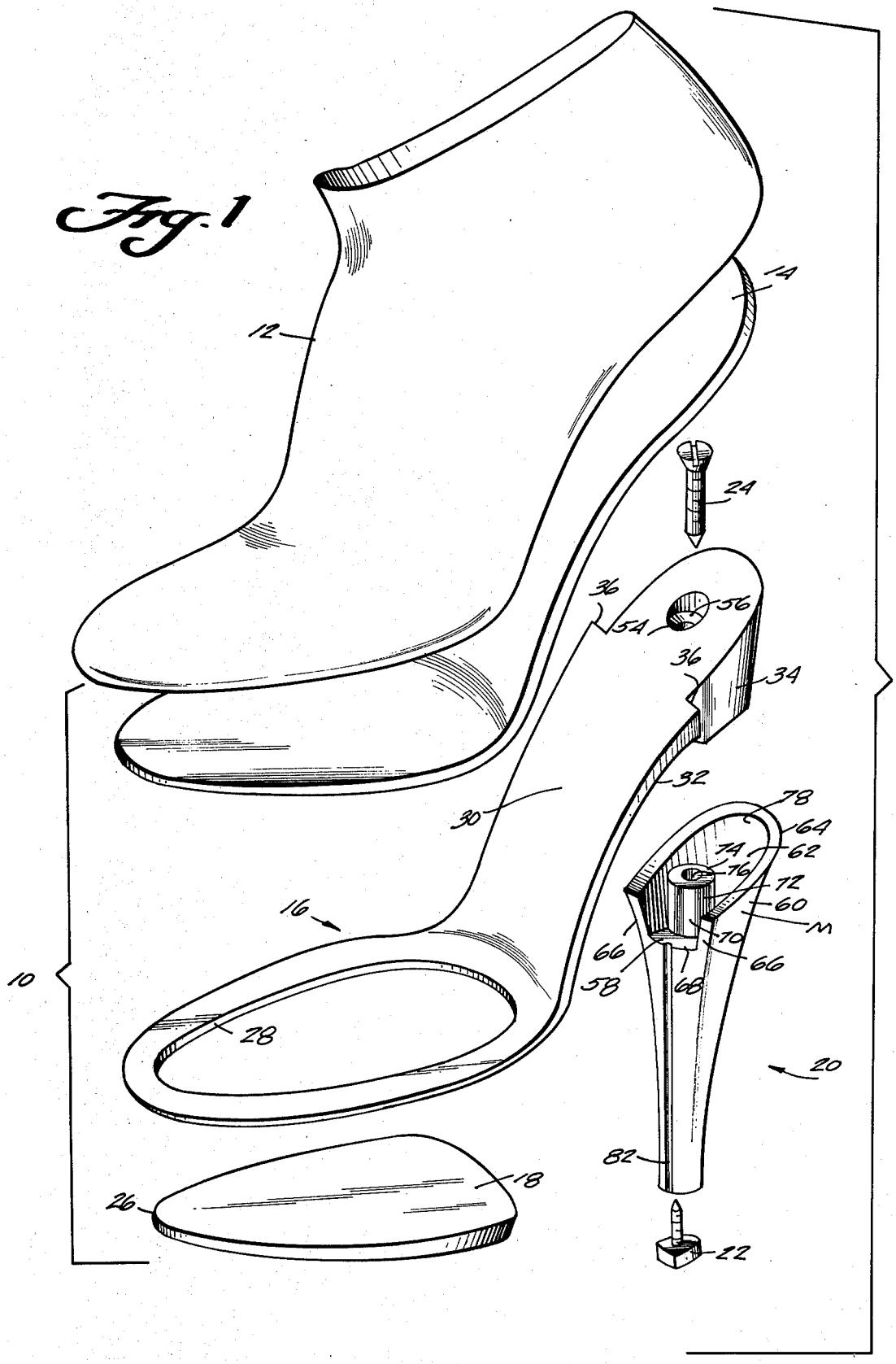
FIG. 1 is an exploded perspective view of a first embodiment of the shoe of the present invention.
Figures 3, 4:
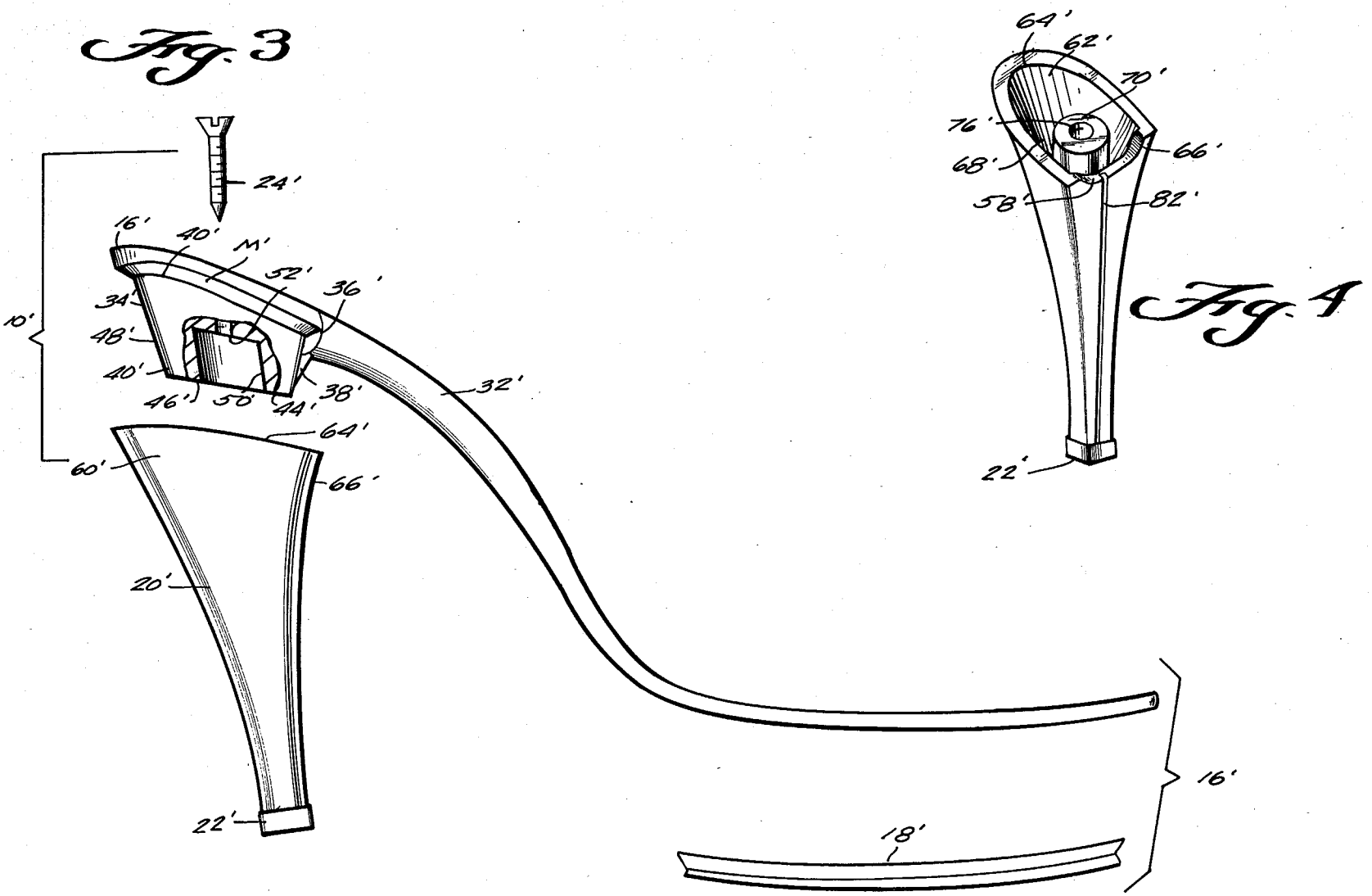
FIG. 3 is an exploded side elevational view of a basic heel-needing shoe sole member and heel member of a second embodiment of the present invention.
FIG. 4 is a perspective view of the heel member of the shoe of FIG. 3.

In FIGS. 1–3 there is shown a shoe 10 which includes a conventional upper which is schematically indicated by the foot-shaped form 12, a conventional inner sole 14, a sole member 16 (in the preferred embodiment, including a ground-engaging inset plate 18), a heel member 20 (in the preferred embodiment, including a conventional lift element 22), and a disconnectable connector 24 (which, in the preferred embodiment is a screw).

By preference, the sole member 16 is injection molded of a semi-rigid plastic material such as nylon or ABS so as to incorporate the ground-engaging sole plate 18 during the molding process. The plate 18 is made, e.g. of genuine leather, and may have its sidewall 26 cut with a radially outwardly concave profile so that it is keyed or locked into place in the sole plate receiving opening 28 during the molding process. If the plate 18 is made of genuine leather, the keying effect is enhanced by entrapment of fibers of the edge surface 26 in the plastic material of the sole member 16 perimetrically of the opening 28.

If considered necessary or desirable, the instep and/or the heel jack region(s) of the molded sole member 16 may have conventionally embedded during the injection molding process a conventional metal shank or the like (not shown).

In manufacturing the shoe 10, a conventional inner sole 14 may be conventionally applied upon the upper surface 30 of the sole member 16 and a conventional upper 12 is conventionally mounted to the inner sole 14 and/or to the sole member 16, or conventionally secured between the inner sole 14 and the sole member 16.

From the sole plate-receiving region towards the heel-needing region, the underside of the sole member 16 is gradually thickened at 32, until at the heel-needing region the sole member is shown discontinuously thickened to provide a generally vertically downwardly projecting boss 34 constituting a heel stub or jack.

As seen in plan view, the boss 34 of the first embodiment is discontinuously wide and long so that it appears as if a C-shaped portion of the sole member is missing to provide two opposite, generally vertical, rearwardly facing shoulders 36. The boss 34 is generally rounded D-shaped in horizontal cross-section with a flatter front/inner wall 38 and a more significantly rounded outer/rear wall 40. The wall 40 extends around about three-quarters of the perimeter of the boss 34 and is downwardly tapered so that the perimeter at its upper edge 42 is substantially greater than the perimeter at its lower edge 44.

The lower surface 46 of the boss 34 is generally flat and horizontal. It is centrally provided with a downwardly-opening cylindrical socket 48 having an internal sidewall 50 and an upper end wall 52. (If the sole member 16 has a metal shank embedded within it, the end wall 62 may conveniently be provided by the lower surface of the shank.)

At the place overlying the socket 48 where the material of the sole member 16 is relatively thin, a small centrally located vertical opening 54 preferably is provided. It is of considerably smaller diameter than the socket 48. The upper surface 30 of the sole member 16 may conveniently be formed with a slight depression 56 which extends perimetrically of the opening 54.

The heel opening 20 has much the external appearance of a conventional woman's shoe high heel, in the instance depicted being of the moderate spike-type which flares upwardly from a small lower end that is shown conventionally provided with a conventional lift element 22.

Throughout much of its height, the heel member 20 is of conventional rounded D-shaped horizontal cross-sectional shape, that is, up to the level 58. From that level up to the upper end, the heel member exists as an outer wall flange or shell 60, with the inner wall and core of the heel member being substantially missing to provide an upwardly and forwardly opening recess 62. The recess 62 has the upper rim 64 of the shell 60, the left and right forward rims 66 of the shell 60 and the lip at the level 58 as its mouth.

Within the recess 62, the internal sidewall of the shell 60 tapers downwardly from the upper rim 64 to the floor 68 which is flat, generally horizontal and has the lip 58 as its front edge.

Centrally located on the flat floor 68 is a vertically upwardly projecting boss 70 having a cylindrical outer sidewall 72 and a generally horizontal, generally flat upper end surface 74.

The boss 70 is shown centrally provided with a vertically upwardly opening internally threaded bore 76.

The heel member 20 preferably is made of a substantially rigid material, such as injection molded nylon, ABS plastic or the like, with or without a conventional embedded reinforcing member (not shown).

The entire outer peripheral sidewall of the heel member 20, or any portion(s) thereof may be conventionally coated or covered with any conventional decorative material, such as genuine leather or any color, decorative urethane or vinyl sheet material or the like.

The heel member 20 is assembled to the sole member 16 by bringing these two members vertically together while each has the spatial orientation shown in FIG. 1. Accordingly, the boss 70 on the heel member enters the socket 48 in the underside of the heel stub of the sole member 16 until the upper end wall 74 of the boss 70 lies adjacent the end wall 52 in the top of the heel member until both the lower end surface 46 comes to rest upon the floor 68 and the internal sidewall 78 of the upstanding, tapering flange shell 60 extensively engages the outer/rear sidewall surface 40 of the heel stub 34.

This relationship may be maintained by threading the screw 24 into the bore 76 through the hole 54 until the screw head tightly engages the upper surface 30 of the sole member 16 within the slight depression 56.

The inner sole 14 covers over the screw head in the slight depression 56, both hiding it from view and protecting the screw head/depression from being sensed by the shoe-wearer through her heel. The inner sole is in this region removably tacked-down to the surface 30 using a conventional adhesive or the like.

In the first embodiment, the upper rim 64 of the shell 60 lies at the same level as the outer margin of the upper surface 30 of the sole member 16 and the outer margin of the inner sole 14 covers both equally to give the assembled shoe 10 a fine, finished appearance.

In order to change the shoe 10 from one having a black sole and a green heel to one having a black sole and a red heel, it is only necessary for the manufacturer, marketer or user to remove the green heel in its entirety and to replace it with a like red one. In the preferred embodiment, this change-over is simply accomplished by pulling-up the rear portion of the inner sole 14 sufficiently to expose the head of the screw 24, threading out the screw 24, vertically downwardly pulling-off the heel member 20, replacing it with the desired heel member, screwing the screw 24 back in, and sticking the rear portion of the inner sole 14 back down onto the surface 30.

A second embodiment of the shoe of the invention is shown at 10' in FIGS. 3–5. Comparable elements are given the same numerals as in FIGS. 1 and 2, with the addition of primes.

All that is different in the version shown in FIGS. 3–5 is that a marginal portion M shown at the upper rim of the shell of the heel member 20 in FIG. 1 is simply omitted from the heel member 20' and, instead, made an integral part of the sole member 16' at a comparable location at M'. Accordingly, in the second version, the upper rim 64' of the shell 60' in the assembled shoe 10' engages the lower surface 80' of the marginal portion M' of the sole member 16' perimetrically of the left and right sides and the back of the heel stub 34'.

In both versions, the left and right forward rims 66, 66' of the shell 60, 60' are shown engaging the rearwardly facing shoulders 36, 36' on the sole member 16, 16'.

Although the invention has been shown provided on a high heeled woman's shoe, it could be provided on a high or heeled shoe for men, women or children, as well as on boots and other similar footwear, all collectively referred to herein as shoes. For instance, the heel member may be from 20 mm. to 100 mm. in height. The screw 24 typically is 2.5 cm. long and has a head that is 5 mm. in diameter. In addition to or instead of using a screw 24 to removably hold the heel member in place, any equivalent fastener (including conventional adhesive) may be employed. Conventional materials used for inner soles 14, 14' include those sold under the brand names Texon and Bontex. Two mm. is a conventional thickness for these members.

The central vertical groove in the front wall of the heel member at 82, 82' may be provided for conventionally receiving the vertical margins of a wrapping of leather or other decorative sheet material covering the sidewall of the heel member.

The thickness of the shoe sole in the region of the sole plate 18 typically is 3 mm.

It should now be apparent that the shoe with removably-mounted heel as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A shoe comprising:

a heel-needing sole member made of semi-rigid molded plastic material including a thickened heel stub portion having a generally vertically downwardly projecting, downwardly tapering outer perimetrical sidewall extending about both lateral sides and the back thereof, said heel stub portion including a generally flat lower end wall having a downwardly opening centrally located generally cylindrical socket;

a heel member including a generally upright body having means providing an upwardly opening recess providing a sidewall shell which extends about at least the lateral sides and back of the body, said shell having an upper rim, said recess having a generally horizontal floor that is centrally provided with an axially upwardly projecting generally cylindrical boss with a generally horizontal, flat upper end lying below said rim, said shell having a downwardly tapering internal surface which matches said downwardly tapering outer perimetrical sidewall of said sole member; and means removably securing said heel member to said heel-needing sole member with said generally cylindrical boss snuggly received in said generally cylindrical socket and said heel stub portion received on the lateral sides and back within said shell, with said downwardly tapering internal surface of said shell in extensive engagement with said downwardly tapering outer perimetrical sidewall of said sole member;

said shell including generally vertical left and right forwardly facing front rims adjoining said upper rim thereof;

said heel-needing sole member including generally vertical left and right rearwardly facing shoulders respectively confronting said left and right front rims.

2. The shoe of claim 1, wherein:

said removable securing means comprises a screw screwed down into means providing an upwardly opening internally threaded bore in said generally cylindrical boss though means defining a small hole vertically through said sole member at said generally cylindrical socket.

3. The shoe of claim 1, wherein:

the sole member has an upper surface and a lower surface; and said upper rim of said shell lies below the upper surface of the sole member and at the same level as said lower surface of a marginal portion of said sole member surrounding the lateral sides and rear of said heel stub portion.

4. The shoe of claim 1, wherein:

said outer perimetrical sidewall of said thickened heel stub portion is generally rounded D-shaped in horizontal cross-section, so as to have a relatively flatter front/inner wall and a significantly more rounded outer/rear wall.

5. A shoe comprising:

a heel-needing sole member made of semi-rigid molded plastic material including a thickened heel stub portion having a generally vertically downwardly projecting, downwardly tapering outer perimetrical sidewall extending about both lateral sides and the back thereof, said heel stub portion including a generally flat lower end wall having a downwardly opening centrally located generally cylindrical socket;

a heel member including a generally upright body having means providing an upwardly opening recess providing a sidewall shell which extends about at least the lateral sides and back of the body, said shell having an upper rim, said recess having a generally horizontal floor that is centrally provided with an axially upwardly projecting generally cylindrical boss with a generally horizontal, flat upper end lying below said rim, said shell having a downwardly tapering internal surface which matches said downwardly tapering outer perimetrical sidewall of said sole member; and means removably securing said heel member to said heel-needing sole member with said generally cylindrical boss snuggly received in said generally cylindrical socket and said heel stub portion received on the lateral sides and back within said shell, with said downwardly tapering internal surface of said shell in extensive engagement with said downwardly tapering outer perimetrical sidewall of said sole member;

the sole member having an upper surface; and said upper rim of said shell lies at the same level as said upper surface of said sole member surrounding the lateral sides and rear of said heel stub portion.

6. A shoe, comprising:

a heel-needing sole member made of semi-rigid molded plastic material including a thickened heel stub portion having a generally vertically downwardly projecting, downwardly tapering outer perimetrical sidewall extending about both lateral sides and the back thereof, said heel stub portion including a generally flat lower end wall having a downwardly opening centrally located generally cylindrical socket;

a heel member including a generally upright body having means providing an upwardly opening recess providing a sidewall shell which extends about at least the lateral sides and back of the body, said shell having an upper rim, said recess having a generally horizontal floor that is centrally provided with an axially upwardly projecting generally cylindrical boss with a generally horizontal, flat upper end lying below said rim, said shell having a downwardly tapering internal surface which matches said downwardly tapering outer perimetrical sidewall of said sole member; and means removably securing said heel member to said heel-needing sole member with said generally cylindrical boss snuggly received in said generally cylindrical socket and said heel stub portion received on the lateral sides and back within said shell, with said downwardly tapering internal surface of said shell in extensive engagement with said downwardly tapering outer perimetrical sidewall of said sole member;

the front of said heel member being notched-out down towards the level of said floor of said upwardly opening recess and said heel stub portion has a front wall surface which is thereby exposed; said heel member at the front thereof below said level being substantially flush with the front of said heel stub portion.

7. The shoe of claim 6, wherein:

said shell includes generally vertical left and right forwardly facing front rims adjoining said upper rim thereof; and said heel-needing sole member includes generally vertical left and right rearwardly facing shoulders respectively confronting said left and right front rims.

* * * * *